US006357459B1

(12) United States Patent
Loughmiller

(10) Patent No.: US 6,357,459 B1
(45) Date of Patent: Mar. 19, 2002

(54) GREASE EXHAUST CLEANING SYSTEM

(75) Inventor: Mervyn Loughmiller, Las Vegas, NV (US)

(73) Assignee: Grease Duct Technologies, LLC, Las Vegas, NV (US)

( * ) Notice: Subject to any disclaimer, the term of this patent is extended or adjusted under 35 U.S.C. 154(b) by 0 days.

(21) Appl. No.: 09/632,560

(22) Filed: Aug. 4, 2000

(51) Int. Cl.[7] ..... B08B 3/02; B08B 9/02

(52) U.S. Cl. ..... 134/167 R; 134/167 C; 134/22.12

(58) Field of Search ..... 134/22.1, 22.11, 134/22.18, 8, 167 C, 167 R, 168 C, 168 R; 239/251, 261, 288, 288.3, DIG. 13; 118/317

(56) References Cited

U.S. PATENT DOCUMENTS

| | | | | |
|---|---|---|---|---|
| 3,795,181 A | | 3/1974 | Lawson | |
| 3,893,831 A | | 7/1975 | Doane | |
| 3,994,310 A | * | 11/1976 | Brandon | 134/167 C |
| 4,031,910 A | | 6/1977 | Lawson | |
| 4,073,302 A | | 2/1978 | Jones | |
| 4,085,735 A | | 4/1978 | Kaufman et al. | |
| 4,164,325 A | * | 8/1979 | Watson | 239/252 |
| 4,216,910 A | | 8/1980 | Kimbrough | |
| 4,677,997 A | | 7/1987 | Strauss | |
| 5,235,963 A | | 8/1993 | Strause | |
| 5,383,975 A | | 1/1995 | Faxon | |
| 5,551,458 A | | 9/1996 | Faxon | |
| 5,874,292 A | | 2/1999 | McMinn, Jr. | |
| 5,875,803 A | | 3/1999 | Leitko et al. | |
| 5,942,044 A | * | 8/1999 | Piguillet | 134/304 |

* cited by examiner

*Primary Examiner*—Randy Gulakowski
*Assistant Examiner*—Saeed T Chaudhy
(74) *Attorney, Agent, or Firm*—TraskBritt

(57) ABSTRACT

A method and apparatus for cleaning passageways such as air ducts or flues. The apparatus includes a body having a nozzle, or plurality of nozzles, rotatably coupled to it. A cage is coupled to the body and circumscribes the rotative path of the nozzle or nozzles. The nozzles are configured such that passage of fluid through the nozzle's orifice propels the apparatus along a defined axis. The nozzles may be further configured such that passage of fluid through the nozzle's orifice imparts a rotating motion of the nozzle about the defined axis. The apparatus is placed in a duct or ventilation passageway, preferably at the highest vertical location of the passageway. Fluid is then passed through the nozzle spraying and cleaning the interior of the duct. The propelling force of the spray causes the apparatus to maneuver its way through the duct system, including through angular transitions, until it travels the entire pathway of the duct.

14 Claims, 8 Drawing Sheets

GREASE EXHAUST CLEANING SYSTEM

BACKGROUND OF THE INVENTION

1. Field of the Invention

The present invention relates generally to the cleaning of ventilation passages such as ducts or flues. More specifically, the present invention relates to the cleaning and maintenance of ventilation passages associated with kitchen ventilation systems wherein grease or other airborne particulates may accumulate within the passageway structure.

2. State of the Art

Restaurants, cafeterias or other such facilities where large amounts of food are cooked and prepared typically implement cooking hoods adjacent the food preparation area. Cooking hoods are large ventilation openings, often overhanging the cooking area such as the stove. The hoods are coupled with air passages, such as ducts or flues, which lead to an external environment. An air handling unit is coupled to the air passages to draw air from the cooking area through the passages and to the external environment. In essence, the hood is an exhaust system to draw smoke, heat and gases created in the cooking and preparation of food away from the cooking area. Such systems are not only desirable, but are typically required for facilities preparing large quantities of food. These systems, however, are not limited to commercial establishments and are often found in residential dwellings.

Over an extended period time, use of the hood and exhaust system results in an accumulation of cooking grease and other associated particulates along the interior of the ventilation ducts. Accumulation of grease within the exhaust system poses various hazards and further impacts the safety and efficiency of the system. The most obvious hazard is the possibility of a fire. The close proximity of the exhaust system to the cooking area, typically above the stove or cooking range, combined with the hot gases passing through the ventilation ducts, creates a serious threat of combustion within the ducts which may develop if the system is not properly maintained. Accumulation of grease within the ductwork, for any length of time, also negatively affects the cleanliness and sanitary condition of a food preparation area, which can affect both food preparers and patrons.

Beyond sanitary and safety concerns, the operation of an exhaust system can be impeded without proper cleaning and maintenance of the duct system. Air handling systems are designed to operate at specific airflow capacities. Typically, a given facility is designed to have an air supply and an air return or, alternatively, an exhaust. It is noted that an air return and an air exhaust are not the same concept. Air return typically refers to the passage of a volume of air from a specific location within a building to the air handling unit for conditioning of the air and subsequent reintroduction of the air into the building. On the contrary, the term exhaust more typically refers to the removal of air from an interior of a building to an external environment. The integration of the supply, return, and exhaust subsystems into a complete system requires design and adjustment of each subsystem with regard to the rate of airflow (expressed in cubic feet per minute, or CFN) imposed upon a particular environment. The system may be designed to create a positive pressure requiring a net positive supply of air (i.e., the supply being rated at a higher CFM than the retumlexhaust). Conversely, a system may be designed to create a negative pressure requiring a net negative supply of air. The most common design is a balanced system wherein the supply of air equals the return and/or exhaust of the air.

The intended use of a specific room, such as for cooking, determines, at least in part, the design of the air system. With this in mind, the accumulation of grease or other materials within a ventilation duct can restrict airflow and prevent the overall air system from operating efficiently. For example, an eight inch diameter duct experiencing a quarter inch accumulation of grease on the interior walls represents approximately a thirteen percent reduction in area. A reduction in the cross sectional area of the duct results in an altered rate of air flow thus disrupting the overall system performance.

To ameliorate the above hazards and impediments, ducts must receive regular cleaning and maintenance. Indeed, with regard to commercial establishments, local ordinances often impose scheduled cleaning of such systems. However, such scheduled cleaning is not always performed. Noncompliance may be based upon a number of factors. Removal of accumulated grease from a ventilation system is typically a difficult and time consuming process. The tight confined spaces of a ventilation system make it extremely difficult to manually remove accumulated grease. For example, a ventilation duct running from the cooking area to an external outlet is typically formed of numerous vertical, horizontal and angular sections joined together. The angular connection of each section makes it difficult for cleaning implements to pass from one section to another. Thus, manual cleaning is typically required, which entails cleaning the ducts section by section. Furthermore, each section varies in length. In many cases a length of duct may be a hundred feet or more requiring clean-outs, or access doors, to be spaced along the length. Each clean-out must then be accessed individually in order to appropriately clean the entire length of duct. The job is even more onerous when the length is horizontally positioned, and the cleaning process cannot be assisted by gravity to help extricate the grease from the duct. Manual cleaning of such exhaust systems is tedious, time consuming, and not always effective.

To assist in the cleaning of ventilation ducts, various systems and devices have been implemented. However, these devices have not been entirely effective and, in many instances, have created additional difficulties. For example, U.S. Pat. No. 3,795,181 issued to Lawson discloses an apparatus for cleaning a ventilation flue utilizing a fixture mounted within the interior of the flue or duct. The system includes a plurality of nozzles or spraying devices mounted on a common tube. A turbine is mounted at the base of the tube causing the tube to rotate about its longitudinal axis upon the passage of fluid through the turbine. While this system may be effective in cleaning the surface of the duct adjacent the plurality of nozzles, it poses various problems. A system of this type does not account for the need to clean out multiple sections, whether they be vertical, horizontal or angular. Indeed, the disclosure only teaches the cleaning of the first vertical section immediately adjacent the hood, or ventilation inlet. Additionally, the system must be physically mounted within the ventilation ductwork requiring various physical modifications to the ductwork and hood. Such a device may be difficult to implement in an existing ventilation system. As a permanent fixture within the duct or flue, the device presents an additional surface to which grease and other particulates can adhere leading to an accumulation of grease within a smaller region of the duct.

Another approach may be seen in U.S. Pat. No. 4,031,910 issued to Lawson. The device disclosed attempts to address the issue of cleaning independent duct lengths regardless of angular orientation. The device also utilizes a tube containing a plurality of spray nozzles, the tube rotating about its longitudinal axis. However, the instant device attempts to put an individual rotating tube in each section of duct, with pipe fittings such as elbows connecting each rotating tube section. While this device attempts to address the issue of cleaning each duct section regardless of its angular orientation, it still poses a few drawbacks. Again, this device is a permanent fixture to be mounted within the ducts. Installation of such a device undoubtedly requires disassembly of any existing ductwork. Such an installation would be time consuming and would likely be cost prohibitive. Thus, there is little likelihood that owners of existing systems would implement such a device. Furthermore, as discussed above, additional components mounted in the interior of the ductwork may result in an increase of grease accumulation over shorter periods of time.

In view of the shortcomings in the art, it would be advantageous to provide an apparatus for cleaning ventilation systems which is effective in removing accumulated grease and deposits, thus reducing or eliminating the need for manual cleaning of the ductwork.

It would also be advantageous to provide a device which does not require any special or permanent fixtures within the ductwork. Such a system could be portable and utilized within various systems regardless of duct length or cross sectional area.

It would be a further advantage to provide a system which is easily implemented within a ventilation system having a plurality of ducts or angular orientations.

BRIEF SUMMARY OF THE INVENTION

In accordance with one aspect of the invention, an apparatus for cleaning a ventilation passageway is provided. The cleaning device includes a body having a central axis. A fluid channel is formed within the body and is defined to have a first and second end. The first end of the fluid channel is adapted to be removably coupled to a fluid source. A nozzle (or alternatively a plurality of nozzles) is sealingly coupled to, and in communication with, the fluid channel. The nozzle is configured to rotate about the central axis. The nozzle may be positioned such that fluid passing through the nozzle causes the nozzle to rotate about the central axis. Furthermore, the nozzle may be positioned such that fluid passing through it propels the entire cleaning device in a direction along the central axis.

A cage is coupled to the body and circumscribes the nozzle. The cage keeps the nozzle from striking an interior surface of a duct during operation of the cleaning device. The cleaning device may be utilized in ducts of various shapes and sizes. The self-propelling feature of the cleaning device, coupled with a properly designed cage, allows the apparatus to work its way through a system of ducts, including maneuvering through elbow type connections or angular transitions of the duct. For example, the cleaning device may transition from a vertical section to an angular, or a horizontal section, for efficient cleaning of the interior of the entire ventilation system.

In accordance with another aspect of the invention, a method is provided for the cleaning of ventilation passageways. The method includes providing an apparatus having a body, a fluid nozzle rotatably coupled to the body and a cage which circumscribes the nozzle. The apparatus is placed in the ventilation passageway and the nozzle is then operably coupled to a fluid source. Fluid is passed through the nozzle and sprayed on the interior of the duct. The nozzle is rotated about a central axis such that the fluid being sprayed from the nozzle is distributed about the entire region adjacent the apparatus. The nozzle is also configured such that passage of fluid through the nozzle imparts a propelling force to the apparatus along the central axis.

The fluid which is passed through the nozzle may be introduced at a high pressure, creating a greater propelling force, as well as a stronger shearing force when the spray contacts the duct surfaces. The fluid may also be heated prior to passage through the nozzle for influencing the physical characteristics of the accumulated deposits within the duct. Similarly the fluid may contain a composition for the dissolution of grease or other type of accumulated matter to improve the efficiency of the cleaning operation.

The method may further include placing a catch basin below the ductwork such that fluid and removed matter may exit through the duct system to be collected by the catch basin. Alternatively, the duct system may be sealed at one end to prevent the fluid and removed matter from exiting the duct in an uncontrolled manner. A drain pipe or other type of outlet may then be connected to the sealed end for displacing the waste material to a remote location.

BRIEF DESCRIPTION OF THE SEVERAL VIEWS OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF THE INVENTION

Figure 1:
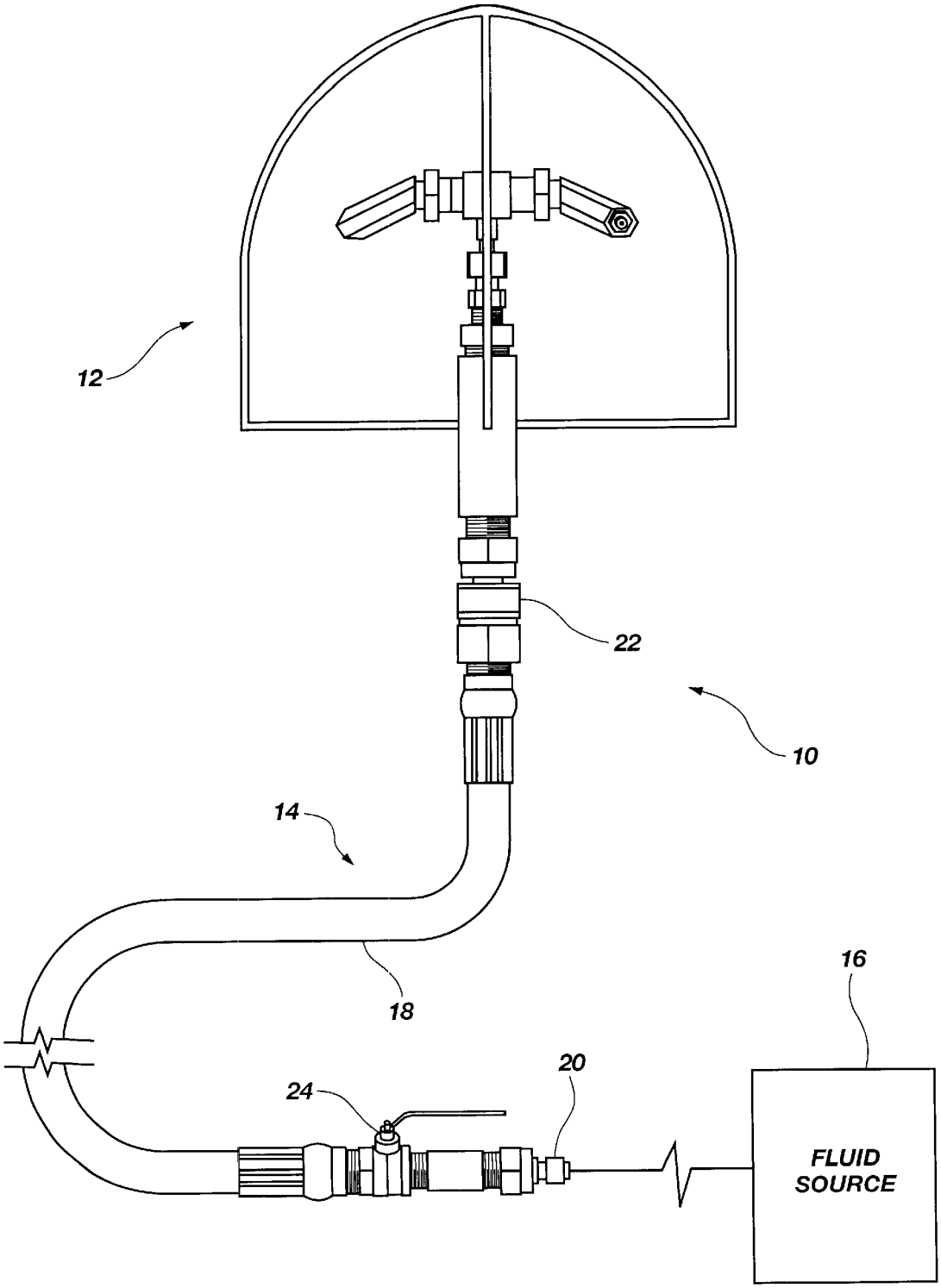
FIG. 1 is an elevational view of an apparatus according to one embodiment of the invention.

Referring to FIG. 1, an apparatus 10 for cleaning ducts, flues, or ventilation passageways according to one embodiment of the present invention, is shown. Apparatus 10 includes a cleaning/spraying device 12, a fluid transfer component or hose 14, and a fluid source 16. The cleaning device 12 is adapted for introduction into a duct or passageway for maneuvering through the passageway for removal of accumulated deposits. The fluid source 16 may be any of a number of fluid sources known in the art. For example, it may include a pump or other means for supplying fluid at a specified rate and pressure. It may also include a heating element for controlling the temperature of the fluid, or a mechanism for introducing, mixing and diluting various chemicals within the base fluid. Such devices and capabilities are well-known to those of ordinary skill in the art and are, therefore, not discussed in greater detail herein.

The fluid transfer component 14 couples the fluid source 16 to the cleaning device 12. While other embodiments are contemplated as being within the scope of the invention, the presently described embodiment is formed of a flexible conduit 18 such as a tubing or hose. The flexible conduit is preferably capable of handling fluids at high pressure. The flexible conduit 18 or hose includes a first coupling 20, shown in the present embodiment as a male quick-connect, at one end, and a second coupling 22, shown as a corresponding female quick-connect, at the other end of the hose 18. The couplings 20 and 22 allow for greater portability, as well as easier setup and operation of the apparatus 10. They also allow flexibility in combining different components for an operation dependent on specific cleaning requirements. For example, some ducts, based on their cross sectional dimensions, may require a cleaning device 12 to have certain minimum or maximum dimensions. Likewise, the length of the ducts will likely vary from one operation to another. This not only affects the required length of the hose, but may affect the required diameter of the hose based of fluid flow requirements. Similarly, different fluid sources may be utilized in different situations. Thus, interconnectivity of the components adds great flexibility to the overall use and operation of the apparatus 10.

A valve 24 is located adjacent to the first coupling 20. The valve 24 is placed in the fluid path to control fluid flow from the fluid source 16 to the cleaning device 12. The valve 24 operates to control fluid flow to the cleaning device 12 from the fluid source 16 and through the first coupling 20. It is noted that while the valve 24 is depicted as being adjacent to the first coupling 20, the valve 24 may be located at any location between the fluid source 16 and the cleaning device 12. The location of the valve is preferably positioned to maximize acceptability and ease of operation during use of the apparatus 10.

Figure 2:
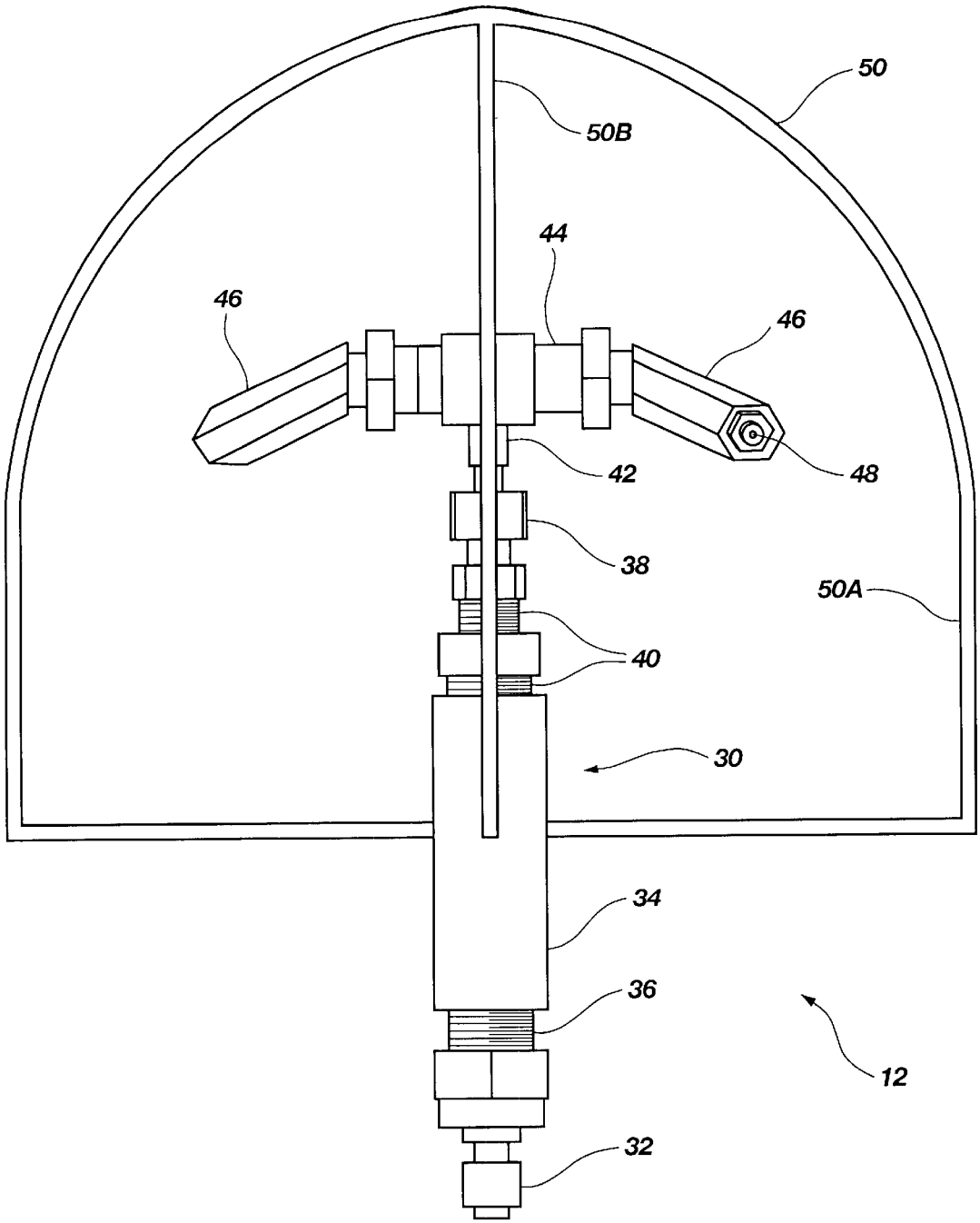
FIG. 2 is an elevational view of a portion of the apparatus disclosed in FIG. 1.
Figure 3:
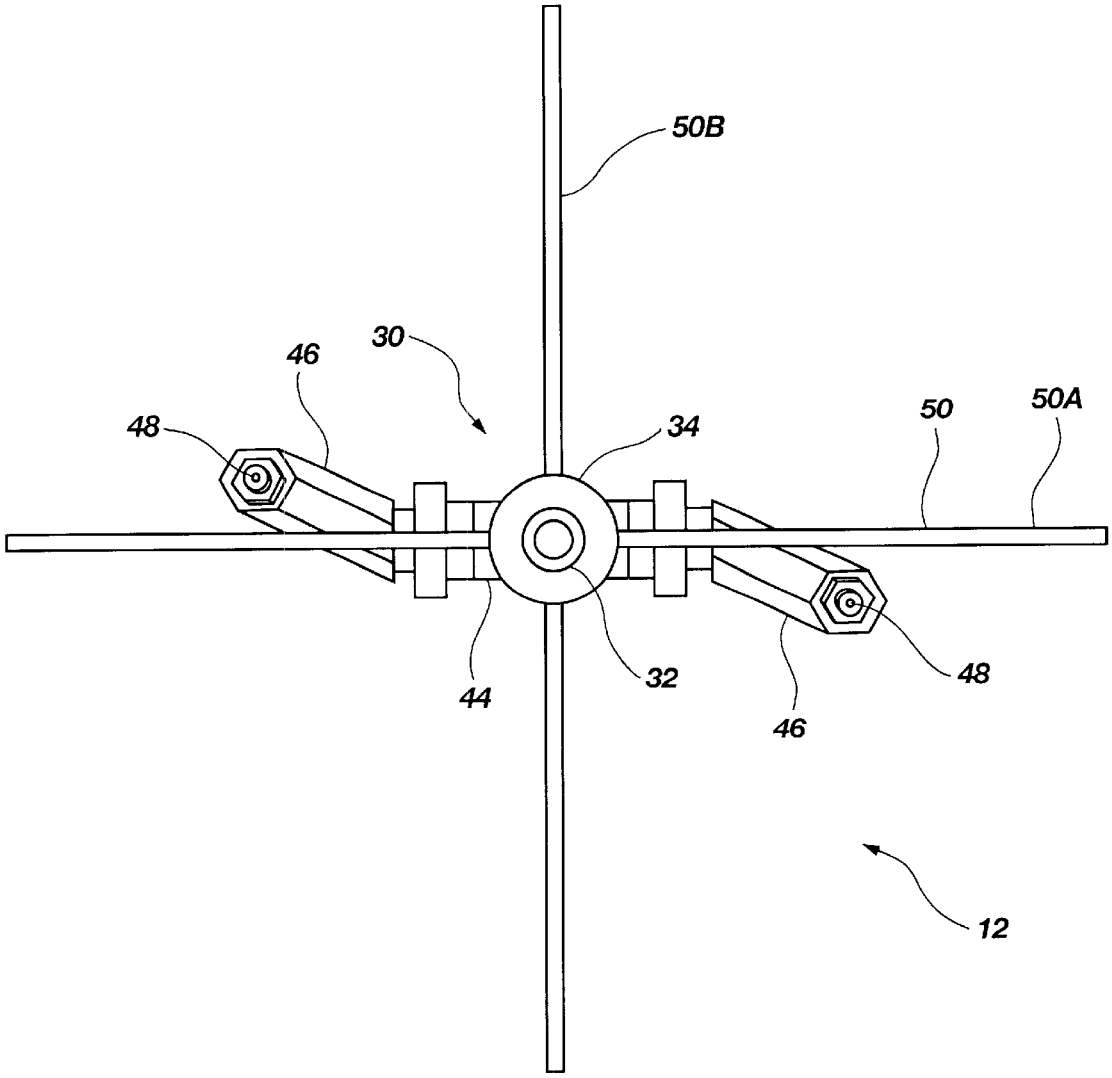
FIG. 3 is a bottom view of the apparatus shown in FIG. 1.

Referring now to FIGS. 2 and 3, a preferred embodiment of the cleaning device 12 is shown from a side view and a bottom view, respectively. The cleaning device 12 is formed of various components which may be collectively considered the body 30 of the device. The body includes a coupling device 32, which is shown here to be a male quick-connect that is configured to mate with the female second coupling 22, shown in FIG. 1. The coupling device 32 is connected to a conduit section 34, such as pipe or tubing which is appropriately sized and rated. FIG. 2 shows the connection to be a threaded connection 36, such as a threaded nipple, however, any other known mechanical connective means are considered to be appropriate as well. A rotatable connection 38, such as a union, swivel or bearing, is connected to the conduit section 34. The rotatable connection 38 is also shown to be connected to the conduit 34 by means of threaded connections 40, however, other fastening means may be employed, such as for example, welding, flanged connections, or any other mechanical means of forming a connection with a fluid tight seal. The body 30 also includes a stem 42, or a second conduit, coupled to the rotatable connection 38.

The body 30 thus comprises several components sealingly coupled together forming an internal fluid path or channel between the coupling device 32 and the stem 42. The body 30 also forms a member which has two sections, one being rotatable with respect to the other. Specifically, the stem 42 is rotatable relative to the conduit 34 about an axis generally defined to run through the body from the coupling device 32 through the stem 42. For sake of convenience and clarity, this axis shall be referred to as the central axis in the specification. It is noted that while the central axis has been defined in terms of the location of physical components, this is not to be considered limiting in any sense. Rather, the axis is actually determined by the relative path of the various components described below. In the presently described embodiment, the axis coincides with both descriptions.

While the body 30, as described above, is formed of multiple components, it may be constructed using other various techniques. For example, the body may be constructed, in large part, by a casting or forging process. Similarly, other constructive techniques are contemplated as being acceptable. However, the mating of various components as discussed above offers the advantage of being simple and inexpensive. Such components are often readily available as standard, off-the-shelf pipe or tube fittings. Another advantage of the disclosed embodiment is the ease of replacement of individual parts, if necessary. A substantially unitary body, while offering other advantages, does not allow for such convenience.

Coupled to the stem 42 of the body 30 is a tee 44. The tee 44 is used to divide and divert the fluid flow from the body into different directions. In this case, the tee 44 serves to divide the flow between two nozzles 46, each being coupled to a separate end of the tee 44. Each nozzle 46 includes an orifice 48 of reduced size such that fluid which passes through orifice 48 is accelerated. The orifice 48 thus forms a fluid stream having a defined trajectory and spray pattern. As seen in FIG. 2, the nozzles 46 are positioned such that the orifices 48 project a fluid stream having a generally downward and angled trajectory with respect to the horizontal plane formed by the tee 44. As seen in FIG. 3, the nozzles 46 and orifices 48 are positioned such that the trajectory of the fluid stream is formed at an angle with respect to the radial axis defined by the tee 44. In other words, the trajectory axis as seen in FIG. 3 does not intersect the central axis that runs through the body 30. The nozzles 46 and/or orifices 48 can be designed to lie at various angles and to provide various spray patterns (e.g., fan or stream).

The angular position of the nozzles 46 plays a significant role in the operation of the cleaning device 12. Reactionary forces experienced by the nozzles 46, due the flow of fluid through the orifices 48, impart a rotating motion to the nozzles 46, tee 44, and stem 42. This causes the nozzles 46 to rotate about the central axis relative to the lower portion of the body 30, including the conduit section 34. Furthermore, reactionary forces experienced by the nozzles 46 in combination with the downward placement of nozzles 46 also propel the cleaning device 12 in a direction which is substantially along the central axis about which the nozzles rotate. Thus, the nozzles 46 serve to both provide a rotating cleaning spray to the interior surfaces of a ventilation passageway as well as to move the cleaning device 12 along the pathway of the duct.

A cage 50 is coupled to body 30, and more specifically, as shown in the disclosed embodiment, the cage 50 is coupled to the conduit section 34. The cage 50 is formed to circumscribe or surround the nozzles 46, as well as their rotative path. As seen in FIG. 2, the cage 50 includes an upper portion which is semispherical. As shall be seen below, the semispherical shape allows the cleaning device 12 to maneuver through various angular transitions which may be encountered in a ventilation passageway. Referring to both FIG. 2 and 3, the disclosed embodiment includes a cage 50 which might be described as having two hoop type members 50A and 50B coupled together in a substantially perpendicular manner. This arrangement is efficient in that it is conducive to use in ducts of various cross-sectional shapes. The cage is easily maneuvered through ducts or passageways having circular, square, or even rectangular cross-sectional geometries, which are the most commonly encountered. It is contemplated, however, that other configurations might be utilized. For example, additional hoop members might be utilized to substantially form a cylindrical shape when viewed from beneath (i.e., as in FIG. 3). Such an embodiment might be particularly suited for use in a duct having a circular cross section. Another alternative might be to form the cage with the hoops being joined in a nonperpendicular manner. This would result in a cage more particularly suited for ducts having a rectangular cross-sectional area. Regardless of the number or angular orientation of the individual hoop members 50A and 50B, the cage could also be formed to be entirely spherical. Such a spherical cage could be used in ducts which require a higher degree of maneuverability for proper navigation of the duct by the cleaning device 12.

The cage 50 may be coupled to body 30 by any suitable mechanical means. Indeed, the method of fastening the cage 50 to the body may be dependent upon the material from which the cage 50 is formed. In the disclosed embodiment, the cage 50 is contemplated as being formed of stainless steel. Stainless steel offers the advantage of being corrosion resistant. Furthermore, stainless steel may be effectively and efficiently fastened to the body 30 by welding. Of course other materials may be utilized to form the cage and may be equally suited for the task. Similarly, the cage 50 need not be fastened to the body 30 by welding. Instead, it is contemplated that an appropriate coupling device may be positioned on the body 30 for removable coupling of the cage 50 to the body 30. A removable coupling, while possibly adding complexity to the manufacture of the cleaning device 12, would offer the advantage of flexibility in choosing a cage size and configuration which is appropriately suited for a duct having a particular size and geometric configuration.

Figure 4:
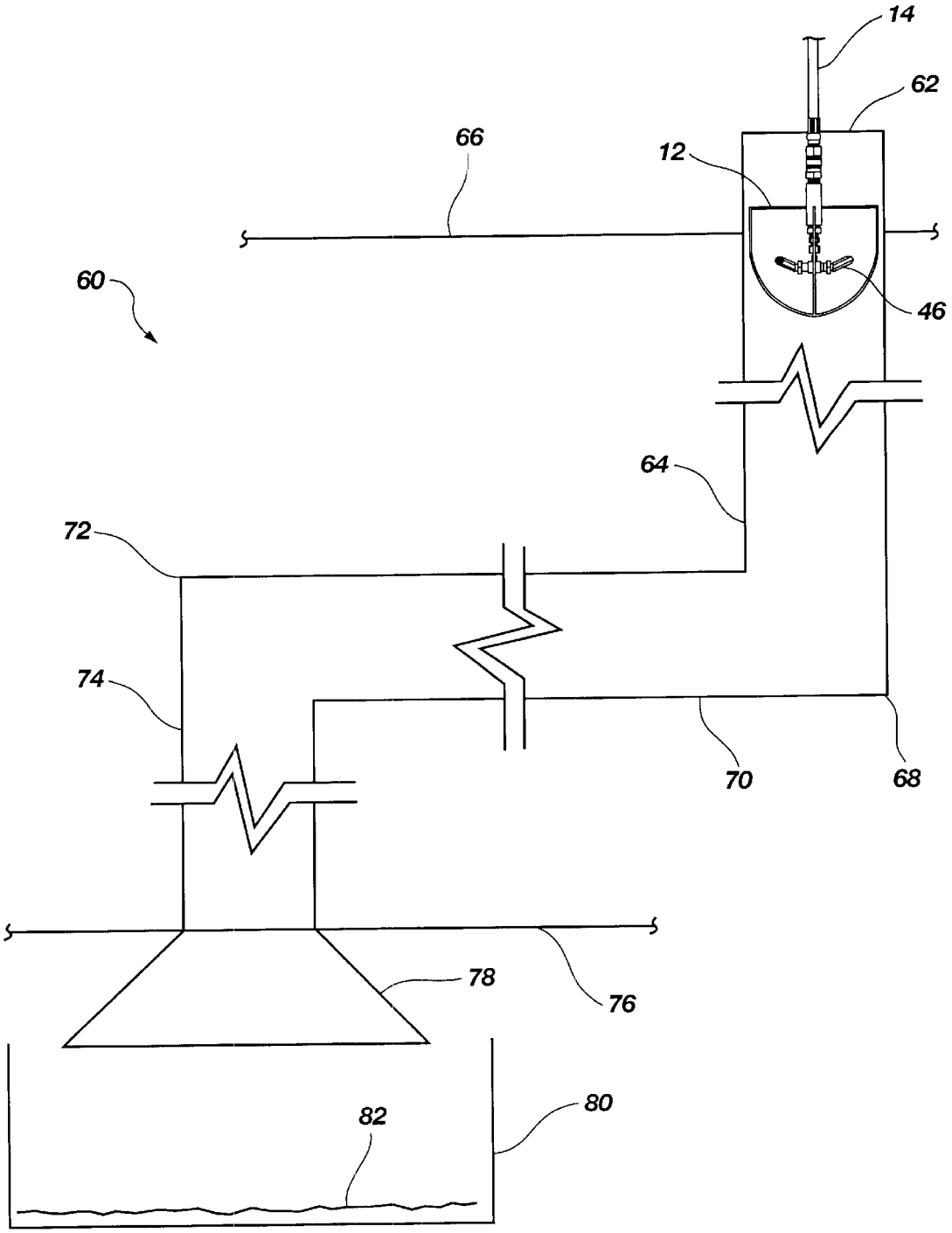
FIG. 4 is a partial sectional view of the apparatus of the present invention employed in a duct system.
Figure 5:
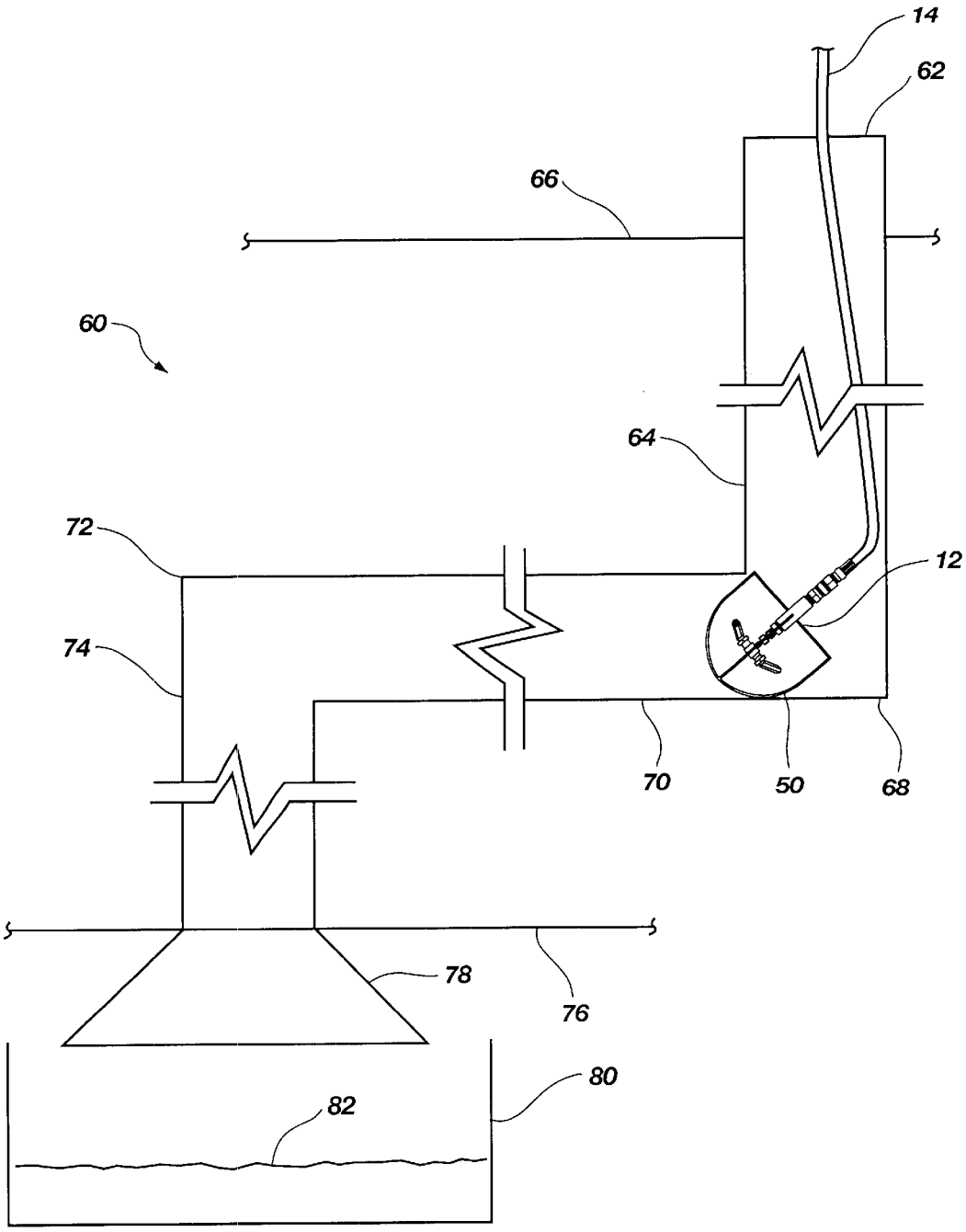
FIG. 5 is an additional partial sectional view of the apparatus of the present invention employed in a duct system.
Figure 6:
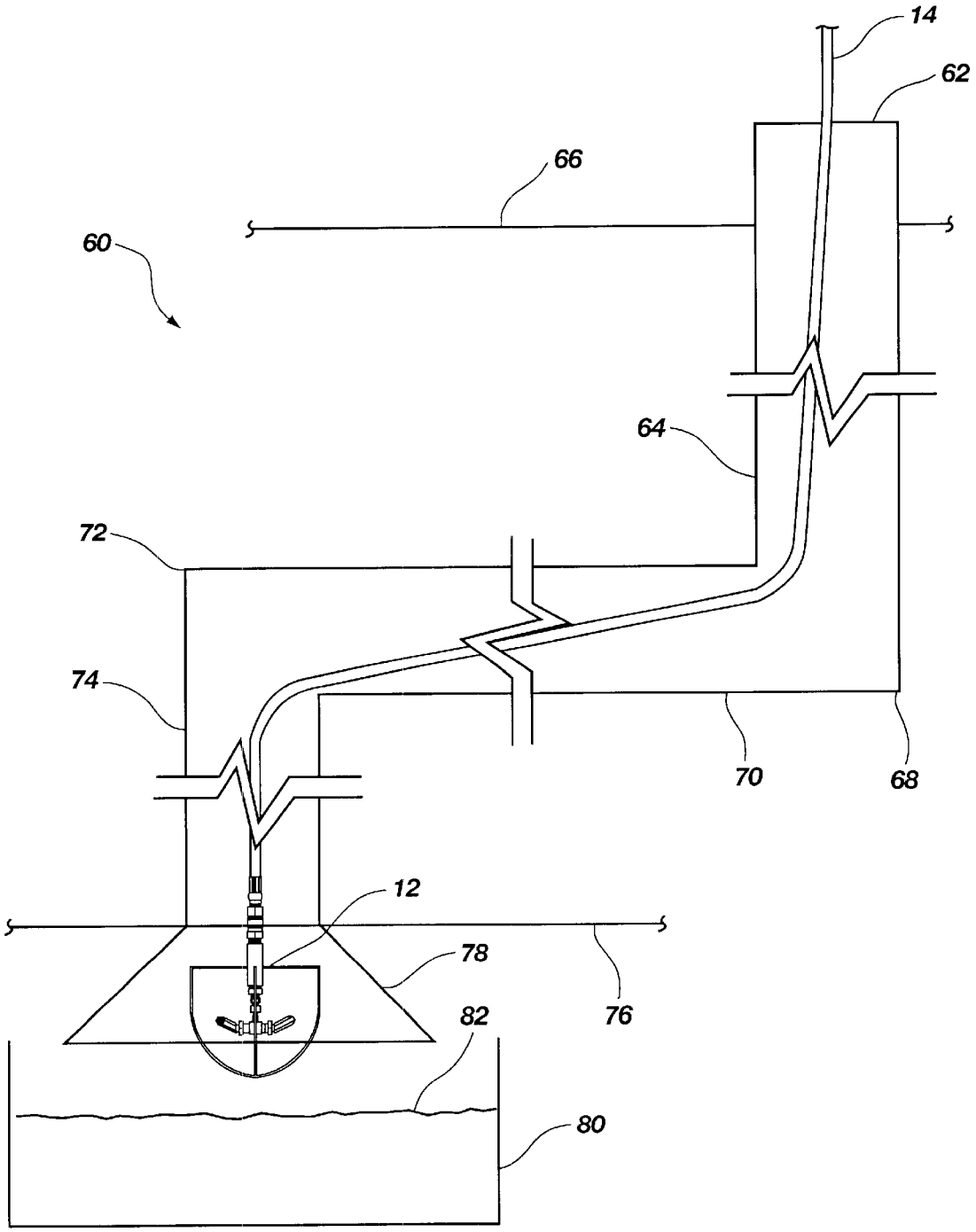
FIG. 6 is a partial sectional view of the apparatus upon completion of cleaning a duct system.

Referring now to FIG. 4, 5, and 6, a representative duct system 60 is shown in which the cleaning apparatus 10 is typically operated. Starting at the exhaust end 62 of the duct system 60, a first vertical leg 64 enters the interior of a building through the roof 66. The first vertical leg 64 makes an angular transition 68 to a horizontal leg 70. The horizontal leg 70 makes a second angular transition 72 to a second vertical leg of duct 74. The second vertical leg 74 extends through the ceiling 76 of a food preparation area and connects with an exhaust hood 78. A catch-basin 80 can be placed below the hood to contain any resultant drainage 82 created by operation of the cleaning device. While not shown, the food preparation area adjacent the catch-basin 80 might also be covered with protective material to protect the equipment from splashing or errant discharge.

Referring to FIG. 4, the cleaning device 12 is connected to a fluid transfer component 14 which, in turn, is coupled to an appropriate fluid source (not shown). The cleaning device 12 is introduced into the first vertical leg of duct 64 at the exhaust end 62 of the duct system 60. Fluid is then passed through the nozzles 46 of the cleaning device 12 and the fluid is sprayed onto the interior surfaces of the duct system 60. The reactionary force of the spray propels the cleaning device downward through the first vertical leg 64, cleaning the duct as it passes through.

Referring to FIG. 5, the cleaning device 12 is shown maneuvering through the angular transition 68 formed between the first vertical leg 64 and the horizontal leg 70. The propelling force, combined with the semispherical shape of the cage 50 allows the cleaning device 12 to rotate through the angular transition 68 so that it may continue through the horizontal leg 70. The cleaning device 12 then continues to propel itself through the horizontal leg 70, cleaning the interior surfaces of the duct as it passes through.

Referring to FIG. 6, the cleaning device 12 has now navigated its way through the entire duct system 60. Following the horizontal leg 70, the cleaning device 12 is maneuvered through the second angular transition 72 and continued through the second vertical leg 74 until it exits through the exhaust hood 78. The fluid source 16 (not shown) is now rendered inoperable, either by turning it off, or operating a valve to terminate the fluid flow. The cleaning device 12 may now be disconnected from the hose 14 and removed. The hose 14 is subsequently pulled through the ductwork. If desired, the operation may now be repeated for a second cleaning, if it is required. Alternatively, the cleaning device 12 can be initially passed through the duct system 60 to spray a solvent or other grease-dissolving chemical or cleaner, followed by a second operation where the cleaning device 12 sprays a fluid to rinse away any remaining grease or contaminants within the duct system 60.

Figure 7:
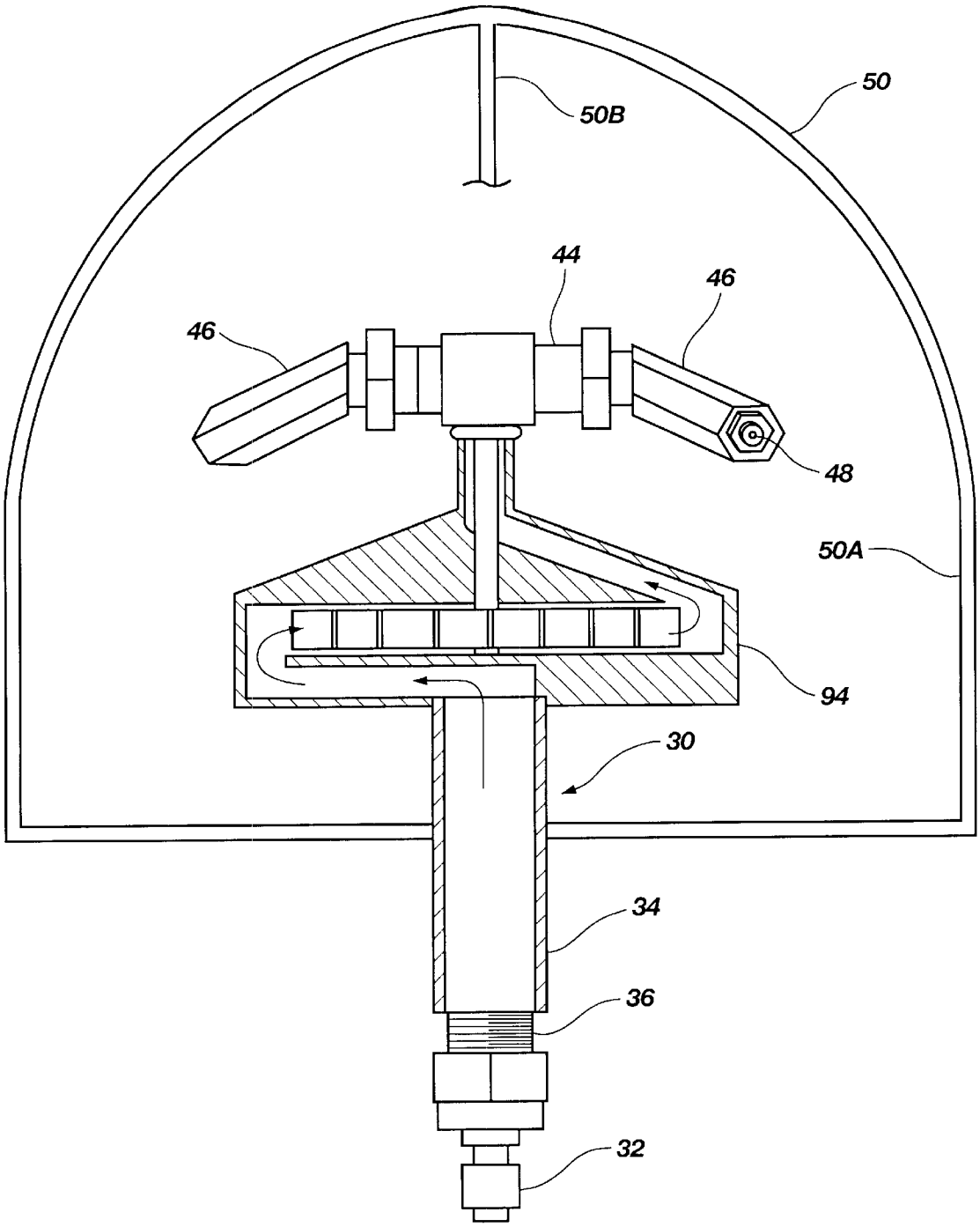
FIG. 7 is an elevational view of an alternative embodiment of the cleaning device of the present invention.
Figure 8:
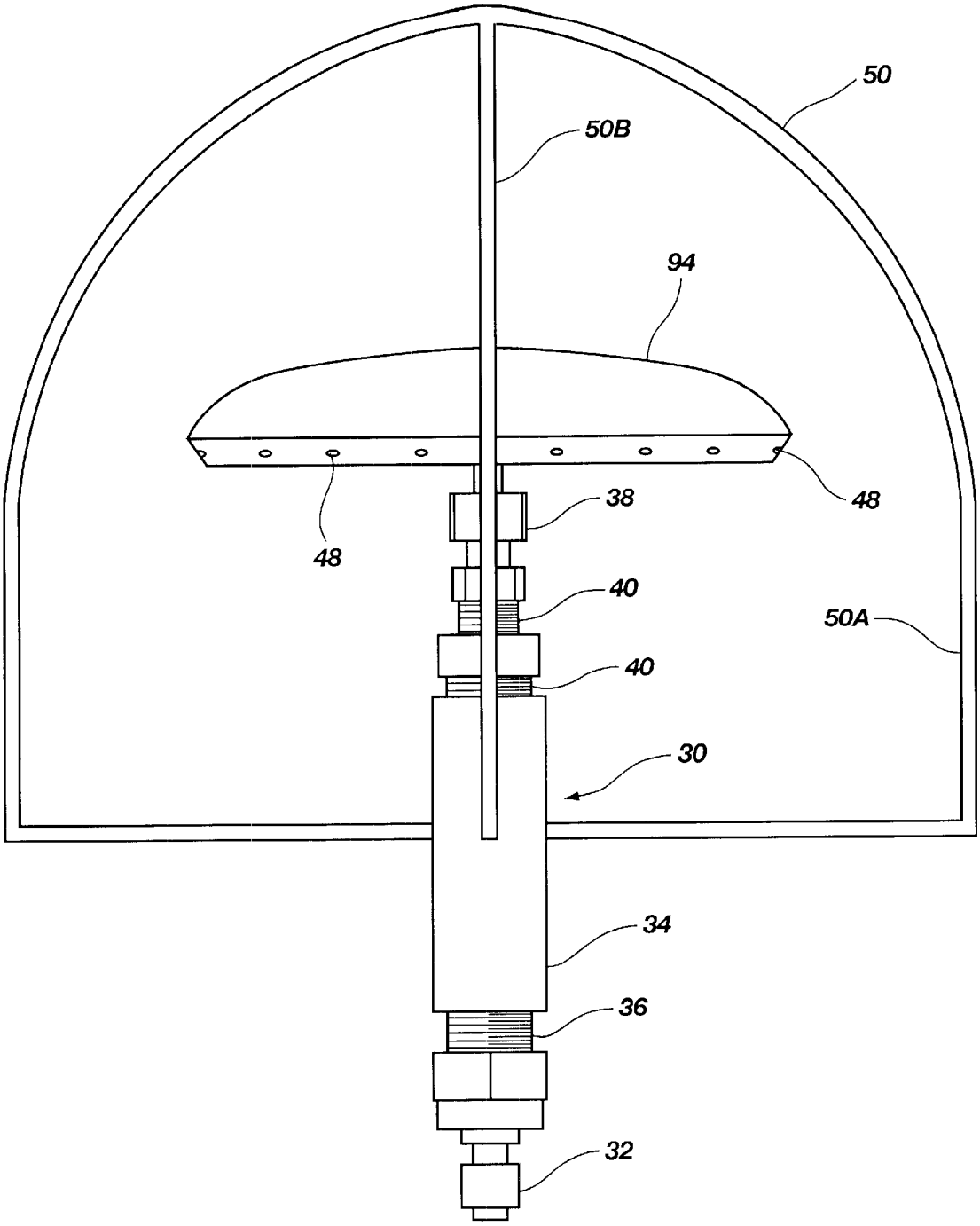
FIG. 8 is an elevational view of yet another alternative embodiment of the cleaning device of the present invention.

It is noted that various modifications are contemplated as being within the scope of the invention. For example, while the disclosed embodiment relies on the angular position of the nozzles to impart rotative motion to the nozzles, rotation may be accomplished by other means. For example, as illustrated in FIG. 7 and FIG. 8, a fluid turbine may be housed within the body 30 of the cleaning device 12 and operatively attached to the tee 44 and the nozzles 46. Passage of fluid across the turbine (shown by arrows) would then impart rotary motion to the turbine, and subsequently to the tee 44 and the nozzles 46. The use of a turbine for rotary motion would thus make the angular position of the nozzles 46, relative to the radial axis, of less significance. Alternatively, as another example, a fluid turbine 94 having a plurality of orifices 48 (e.g., jet orifices) may be mounted on rotatable connection 38 by any suitable means, such as a bearing means as shown in FIG. 8. The orifices 48 form a fluid stream having a defined trajectory and spray pattern, and are positioned to project a fluid stream having a generally downward and angled trajectory in relation to the horizontal axis of the fluid turbine 94 when fluids are introduced through the body 30, as described in reference to FIG. 2 above.

In all of the illustrated embodiments, it is also contemplated that adjustable, and/or replaceable nozzles 46 may be used with the cleaning device 12. Adjustable nozzles would allow the user to define the angular position of the nozzles 46 effectively adjusting the rotative and propulsive forces experienced by the cleaning device 12. Thus, in certain situations, it may be desirable to have the cleaning device travel at a slower rate through the duct work. Similarly, it may be desirable to change the trajectory angle of the fluid stream depending on the type of material, or level of accumulation within the duct. Use of replaceable nozzles would allow the user to change spray patterns. For example, a direct stream nozzle might be replaced by a nozzle creating a fan pattern for subsequent washing or treatment of the duct system. The ability to interchange nozzles would allow further customization of the cleaning device 12 for use with a specific duct system.

It is also noted that while the invention has been disclosed in terms of cleaning exhaust systems associated with food preparation areas, the invention is not be considered as being limited to such an environment. Indeed, numerous applications exist for the invention in which extended narrow passages require cleaning or maintenance, particularly in situations which require navigation through angular transitions.

Although the preferred embodiments of the present invention have been disclosed for illustrative purposes, those skilled in the art will appreciate that various modifications, additions, and substitutions are possible, without departing from the scope and spirit of the invention as disclosed in the accompanying claims.

What is claimed is:

1. An apparatus for cleaning a ventilation passageway comprising:

a body having a central axis defined to pass through the body;

a fluid channel formed within the body, the fluid channel having a first and a second end, wherein the first end of the fluid channel is adapted to be removably coupled to a fluid source;

at least one nozzle sealingly coupled to and in communication with the second end of the fluid channel, wherein the at least one nozzle is rotatable about the central axis of the body; and a cage coupled to the body wherein the cage completely surrounds the at least one nozzle.

2. The apparatus of claim 1, wherein a rotative path is defined by the rotation of the at least one nozzle about the central axis and wherein the cage surrounds the rotative path.

3. The apparatus of claim 2, wherein a portion of the cage is semispherical.

4. The apparatus of claim 1, wherein the at least one nozzle is configured such that passage of a fluid through the at least one nozzle imposes a rotational motion of the at least one nozzle about the central axis and moves the apparatus in a direction along the central axis.

5. The apparatus of claim 1, further comprising a turbine located in the fluid channel and coupled to the at least one nozzle such that rotation of the at least one nozzle about the central axis is controlled by the turbine.

6. The apparatus of claim 5, wherein the at least one nozzle is configured such that passage of a fluid through the at least one nozzle motivates the apparatus in a direction along the central axis.

7. The apparatus of claim 1, wherein the cage is configured to be maneuverable through an angular transition in the ventilation passageway.

8. The apparatus of claim 1, wherein the at least one nozzle is positioned at a predefined radial distance from the central axis.

9. The apparatus of claim 1, wherein the at least one nozzle includes two nozzles wherein each nozzle is located a predefined radial distance from the central axis and wherein the two nozzles are located substantially 180 degrees from each other about the central axis.

10. The apparatus of claim 1, further comprising a fluid source including a flexible conduit removably coupled to the first end of the fluid channel.

11. The apparatus of claim 10, further comprising a valve coupled to the flexible conduit wherein the valve alternatively allows and disrupts communication between the fluid source and the fluid channel.

12. An apparatus for cleaning ventilation passages comprising:

a body having a central axis, the body having a first and a second end;

a first fluid channel formed within the body from the first end to the second end of the body;

at least one nozzle radially displaced from the central axis and in communication with the first fluid channel, the at least one nozzle configured to define a fluid trajectory axis wherein the fluid trajectory axis does not intersect the central axis and wherein the at least one nozzle is rotatable about the central axis; and a cage coupled to the body completely surrounds the at least one nozzle.

13. The apparatus of claim 12, wherein the cage surrounds a rotative path of the at least one nozzle about the central axis.

14. The apparatus of claim 13, wherein a portion of the cage is semispherical.

* * * * *

UNITED STATES PATENT AND TRADEMARK OFFICE

CERTIFICATE OF CORRECTION

PATENT NO. : 6,357,459 B1
DATED : March 19, 2002
INVENTOR(S) : Mervyn Loughmiller It is certified that error appears in the above-identified patent and that said Letters Patent is hereby corrected as shown below:

Column 1,
Line 60, change “CFN” to -- CFM --
Line 63, change “retumlexhaust” to -- return/exhaust --

Signed and Sealed this

Twenty-sixth Day of October, 2004

JON W. DUDAS
*Director of the United States Patent and Trademark Office*